US011207883B2

(12) United States Patent
Kaiba et al.

(10) Patent No.: US 11,207,883 B2
(45) Date of Patent: Dec. 28, 2021

(54) LIQUID JET DEVICE

(71) Applicants: Tadashi Kaiba, Tokyo (JP); Shuusei Murai, Tokyo (JP)

(72) Inventors: Tadashi Kaiba, Tokyo (JP); Shuusei Murai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/514,165

(22) Filed: Jul. 17, 2019

(65) Prior Publication Data

US 2020/0031117 A1 Jan. 30, 2020

(30) Foreign Application Priority Data

Jul. 24, 2018 (JP) ..... JP2018-138118
Jun. 7, 2019 (JP) ..... JP2019-107165

(51) Int. Cl.
*B41J 2/045* (2006.01)
*B41J 2/21* (2006.01)
*B41J 19/14* (2006.01)

(52) U.S. Cl.
CPC ..... *B41J 2/04516* (2013.01); *B41J 2/04508* (2013.01); *B41J 2/2135* (2013.01); *B41J 19/145* (2013.01); *B41J 2202/15* (2013.01); *B41J 2202/20* (2013.01)

(58) Field of Classification Search
CPC ..... B41J 2/04516
See application file for complete search history.

(56) References Cited

U.S. PATENT DOCUMENTS 5,661,507 A * 8/1997 Sperry ..... B41J 19/145 347/9
6,299,270 B1 10/2001 Merrill
9,033,464 B2 5/2015 Kaiba et al.
(Continued)

FOREIGN PATENT DOCUMENTS

JP 2004-255806 9/2004
JP 2004255806 A * 9/2004
(Continued)

OTHER PUBLICATIONS

Machine generated English translation of JP2004255806A to Nunokawa, "Printer, Method for Printing, and Printing System"; generated via www.espacenet.com on Mar. 16, 2021; 14pp. (Year: 2021).*
(Continued)

*Primary Examiner* — Shelby L Fidler
(74) *Attorney, Agent, or Firm* — IPUSA, PLLC

(57) ABSTRACT

A liquid jet device includes a head that discharges liquid to an object; a moving mechanism that moves at least one of the object and the head; and a controller that causes the head to discharge the liquid while moving the at least one of the object and the head in a first direction to form a first row of dots, and causes the head to discharge the liquid while moving the at least one of the object and the head in a second direction opposite the first direction to form a second row of dots that overlaps the first row of dots. The controller causes the center of the first dot in the second row of dots to be shifted from the center of the last dot in the first row of dots by a distance greater than or equal to a distance d.

6 Claims, 8 Drawing Sheets

(56) References Cited

U.S. PATENT DOCUMENTS

| | | | | |
|---|---|---|---|---|
| 2006/0109291 | A1* | 5/2006 | De Pena | B41J 2/2132<br>347/12 |
| 2006/0125865 | A1* | 6/2006 | Shibata | B41J 2/2054<br>347/15 |
| 2007/0019031 | A1* | 1/2007 | Murayama | B41J 19/147<br>347/43 |

FOREIGN PATENT DOCUMENTS

| | | |
|---|---|---|
| JP | 2007-216475 | 8/2007 |
| JP | 4210014 | 1/2009 |
| JP | 2011-148113 | 8/2011 |
| JP | 2013-052627 | 3/2013 |
| JP | 2018-122225 | 8/2018 |

OTHER PUBLICATIONS

Extended European Search Report for 19186744.9 dated Nov. 22, 2019.

Iwamoto et al., "Advanced Display Technology Series 8, Digital Hardcopy Technology", Kyoritsu Shuppan Co., Ltd., Nov. 2000, Chapter 7 Ink Jet Records, pp. 151-154 with English Translation.

* cited by examiner

LIQUID JET DEVICE

CROSS-REFERENCE TO RELATED APPLICATIONS

The present application claims priority under 35 U.S.C. § 119 to Japanese Patent Application No. 2018-138118, filed on Jul. 24, 2018 and Japanese Patent Application No. 2019-107165, filed on Jun. 7, 2019. The contents of which are incorporated herein by reference in their entirety.

BACKGROUND OF THE INVENTION

1. Field of the Invention

An aspect of this disclosure relates to a liquid jet device.

2. Description of the Related Art

When painting a rectangular painting area, which has, for example, a length of about 200 mm and a width of about 1,000 mm, on an object by using a liquid jet head held on an XY driving table, paint dots discharged from the liquid jet head are placed on the object at regular intervals in both the vertical and horizontal directions. FIG. 6 is an enlarged view of dots placed on the object. When painting is performed under conditions where the nozzle diameter is 0.15 mm, the nozzle speed in the X direction is 640 m/s, the distance between the surface of the object and the liquid jet head is 10 mm, the diameter of the dots is 2.0 mm, and the dot interval is 0.2 mm, 5,000 dots are placed on each row and a range of about 1,000 mm (precisely, 1,002 mm) is covered in the X direction. On the other hand, in the Y direction, 1,000 dots are placed on each column and a range of about 200 mm (precisely, 202 mm) is covered. Thus, the painting area of about 200 mm×about 1,000 mm is covered with $5{,}000\times1{,}000=5\times10^6$ dots.

In the X-direction, the nozzle head mounted on the XY driving table moves at a constant speed from side to side, and discharges dots when entering the target painting area. In the Y direction, the liquid jet head is moved by the Y-axis movement of the XY table so that dots are arranged at 0.2-mm intervals. A related-art painting method performed by a liquid jet head is described above.

However, the related-art painting method described above has problems as described below. These problems are described below with reference to FIGS. 7A and 7B. In FIG. 7A, dot groups 102, which look like thin vertical lines at the right and left edges of a painting area 101, seem to protrude from the painting area 101. When the dot groups 102 are magnified with a microscope, as illustrated in FIG. 7B, the dot groups 102 are groups of small dots with a diameter of about 100 μm and protrude from the target painting area 101. The dot groups 102 are located to the right of the rightmost dots of dots formed from left to right and to the left of the leftmost dots of dots formed from right to left. These protruding dots are undesirable noise in forming a painting area with a clear edge.

Reasons why such "noise dots" are generated are described below. For example, "Advanced Display Technology Series 8, Digital Hardcopy Technology, KYORITSU SHUPPAN CO., LTD., November 2000, pp. 151-154, Responsible Editors Iwamoto and Kodera" describes a mechanism for discharging paint dots from nozzles of a liquid jet head. However, when a paint (ink) dot discharged from a nozzle of a liquid jet head is more closely examined using, for example, a stroboscopic microscope, the dot changes as illustrated in FIGS. 8A through 8E as time passes. FIGS. 8A through 8E illustrate a process where dots are formed. FIG. 8A is a cross-sectional view of a nozzle before a dot is discharged, FIG. 8B is a cross-sectional view of the nozzle immediately after a dot is discharged, FIG. 8C illustrates a state where the dot discharged in FIG. 8B is separated into a parent dot and a satellite dot, FIG. 8D illustrates a state after a given time period from the state illustrated by FIG. 8C, and FIG. 8E illustrates a state where the parent dot has fallen onto an object and the satellite dot is still flying.

Each of FIGS. 8A through 8E is explained in more detail. When the tip of a nozzle 2N is filled with paint 20 (FIG. 8A), a pressure is applied to the paint 20 from behind and the paint 20 is discharged as a paint dot 2*a*. At the moment when the paint dot 2*a* is discharged, the tail of the paint dot 2*a* is pulled backward due to the viscosity and the surface tension of the paint 20 in the tip of the nozzle 2N. As a result, the paint dot 2*a* assumes a sharp conical shape (FIG. 8B). The tail of the paint dot 2*a* separates from the body (parent dot 2*b*) of the paint dot 2*a* and becomes a small dot 2*c*. This small dot 2*c* is referred to as a "satellite dot" (FIG. 8C). Because the tail of the paint dot 2*a* is pulled backward, the fall velocity of the satellite dot 2*c* becomes slower than the fall velocity of the parent dot 2*b*. When the parent dot 2*b* falls onto a painting area 101 on an object 100 and spreads out, the satellite dot 2*c* is still in the air (FIG. 8D) and falls onto the parent dot 2*b* thereafter (FIG. 8E).

In actual painting, the liquid jet head moves in the X direction, for example, rightward at a constant speed. Accordingly, as indicated by vector velocities in FIG. 9, the satellite dot 2*c* with a lower fall velocity falls onto a position to the right of the parent dot 2*b* with a higher fall velocity. On the other hand, when the nozzle 2N moves leftward, the satellite dot 2*c* falls onto a position to the right of the parent dot 2*b*. These satellite dots 2*c* constitute noise dots that protrude from the left and right edges of the painting area.

For example, when paint was discharged from a nozzle having a diameter of 0.15 mm and moving at a constant speed of 640 mm/s in the X direction, the vertical fall velocity of the parent dot 2*b* was 5,850 mm/s, the vertical fall velocity of the satellite dot 2*c* was 4,300 mm/s, the diameter of the parent dot 2*b* fallen onto the object 100 located 10 mm below the nozzle was 2.0 mm, the diameter of the satellite dot 2*c* was 0.1 mm, and the position of the satellite dot 2*c* was at a distance of 0.4 mm from an edge of the parent dot 2*b*.

Japanese Patent No. 4210014 discloses a method for solving the above-described problem of satellite dots. According to an inkjet printing method disclosed in Japanese Patent No. 4210014, in a printing process where an inkjet print head including multiple nozzles is positioned adjacent to a sheet of a printing medium and the sheet or the print head is moved in a scanning axis direction, ink droplets (satellite dots) are discharged from one of the nozzles in a direction inclined relative to a direction that is orthogonal to the scanning axis, and parameters and the scanning speed are selected such that the body and the tail of each ink droplet falls onto the same position on the sheet.

However, with the method disclosed in Japanese Patent No. 4210014, it is necessary to configure a nozzle such that the center of the inlet of the orifice of the nozzle defines a normal axis and the center of the outlet of the orifice is shifted from the normal axis by an offset amount. Thus, this configuration requires a dedicated nozzle.

SUMMARY OF THE INVENTION

According to an aspect of this disclosure, a liquid jet device includes a head that discharges liquid to an object; a moving mechanism that moves at least one of the object and the head; and a controller that causes the head to discharge the liquid while moving the at least one of the object and the head in a first direction to form a first row of dots, and causes the head to discharge the liquid while moving the at least one of the object and the head in a second direction opposite the first direction to form a second row of dots that overlaps the first row of dots. The controller causes the center of the first dot in the second row of dots to be shifted from the center of the last dot in the first row of dots by a distance greater than or equal to a distance d.

DESCRIPTION OF THE EMBODIMENTS

An aspect of this disclosure makes it possible to improve image quality by controlling the discharge of paint dots. A liquid jet device and painting methods performed by the liquid jet device according to embodiments are described below with reference to the accompanying drawings.

First, an inkjet printer that performs painting methods according to the embodiments is described.

Configuration of Inkjet Printer

Figure 1:
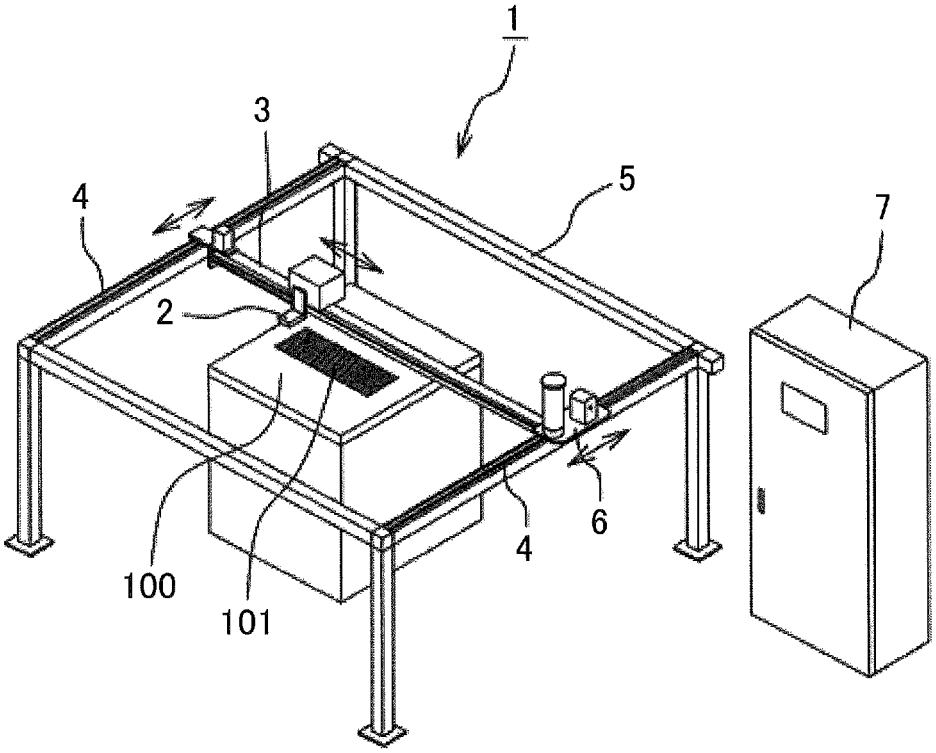
FIG. 1 is a drawing illustrating a configuration of an inkjet printer including a liquid jet head according to an embodiment.

As illustrated in FIG. 1, an inkjet printer (which may be simply referred to as a "printer") includes a liquid jet head 2 (which may be simply referred to as a "nozzle head") that discharges paint dots toward a painting area 101 of an object 100, an X-axis moving mechanism 3 that moves the nozzle head 2 forward and backward in an X-axis direction, a pair of Y-axis moving mechanisms 4 that support the X-axis moving mechanism 3 and move the nozzle head 2 forward and backward in a Y-axis direction, an XY table frame that supports the ends of the Y-axis moving mechanisms 4 and holds the Y-axis moving mechanisms 4 at a predetermined height, a paint supply device 6 that supplies paint to the nozzle head 2, and a controller 7 that controls the nozzle head 2, the X-axis moving mechanism 3, and the Y-axis moving mechanisms 4 (XY table) according to painting data. Here, the inkjet printer 1 is an example of a "liquid jet device".

The nozzle head 2 is caused to move in the X and Y directions above the surface of the painting area 101 of the object 100 by the X-axis moving mechanism 3 and the Y-axis moving mechanisms 4. While the nozzle head 2 is being moved, inkjet nozzles (not shown) of the nozzle head 2 discharge paint dots toward the painting area 101 to be painted and thereby form a paint film on the painting area 101.

Figure 2:
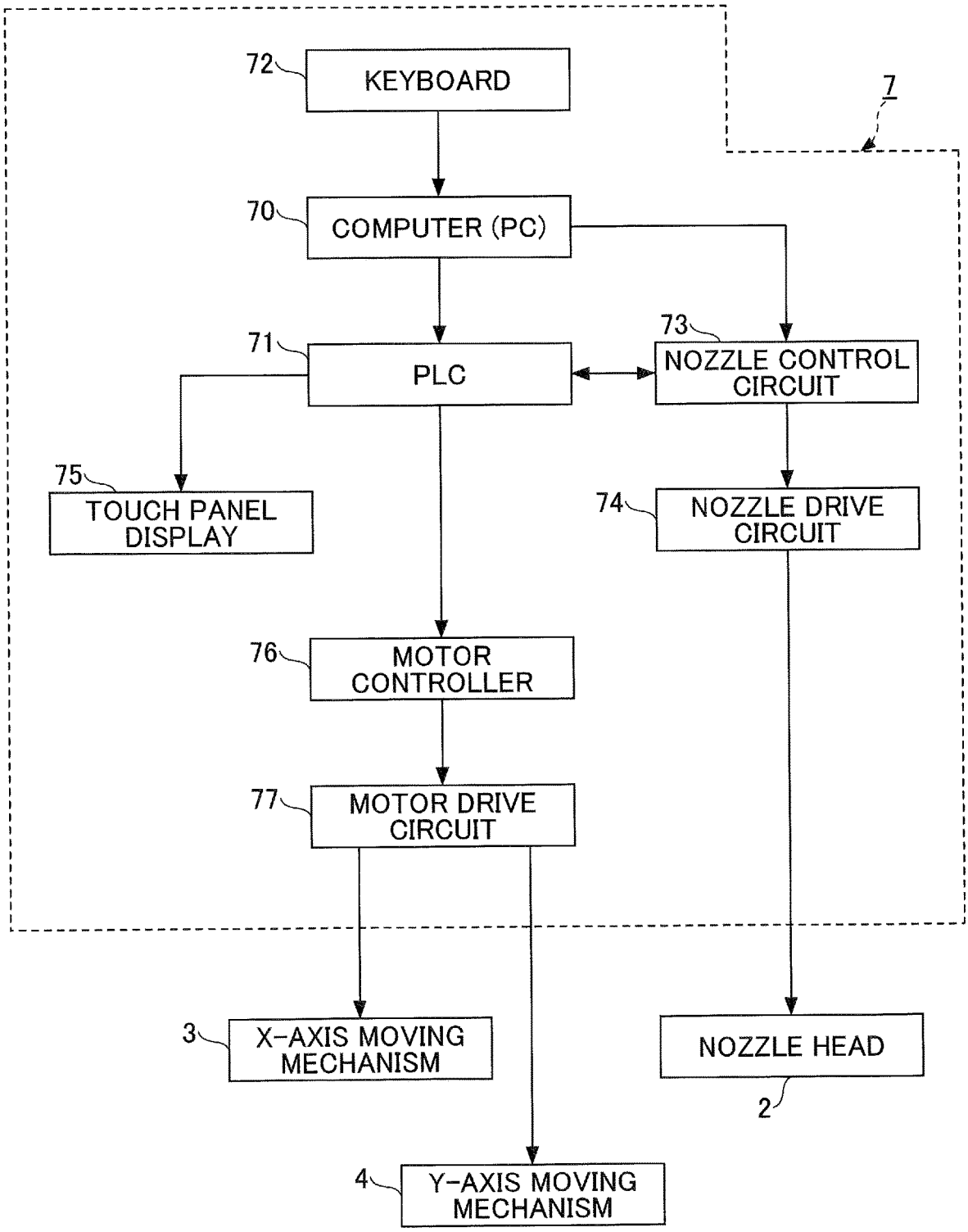
FIG. 2 is a block drawing illustrating a controller according to an embodiment.

FIG. 2 is a block diagram illustrating an example of the controller 7. The controller 7 includes a computer (PC) 70 that controls the printer according to a stored program, and a programmable logic controller (PLC) 71 that is controlled by the PC 70 to perform control processes in a predetermined order. A keyboard 72 for various input operations and a nozzle control circuit 73 for controlling the operations of the nozzle head 2 are connected to the computer 70. The nozzle control circuit 73 is connected to a nozzle drive circuit 74 that drives the nozzle head 2 under the control of the nozzle control circuit 73.

The PLC 71 that operates under the control of the computer 70 and the nozzle control circuit 73 is connected to a touch panel display 75 that displays various types of information and enables a user to input instructions by touching the screen and to a motor controller 76 that controls driving motors (not shown) of the X-axis moving mechanism 3 and the Y-axis moving mechanisms 4. The motor controller 76 is connected to a motor drive circuit 77 that drives the driving motors under the control of the motor controller 76.

When the painting area 101 has dimensions of about 200 mm×about 1,000 mm, the painting area 101 is covered by an array of $5{,}000\times1{,}000=5\times10^6$ dots as described above. In this case, the nozzle head 2 mounted on the X-axis moving mechanism 3 is moved right and left at a constant speed in the X direction, and discharges dots when the nozzle head 2 enters the target painting area. In the Y-axis direction, the Y-axis moving mechanisms 4 are driven to move the nozzle head 2 such that dots are arranged at an interval of 0.2 mm.

The computer 70 controls the PLC 71 and the nozzle control circuit 73 according to a pre-stored program and thereby drives the X-axis moving mechanism 3, the Y-axis moving mechanisms 4, and the nozzle head 2 to form a print pattern. During this process, the nozzle head 2 discharges paint dots onto the object 100 at regular intervals in both the vertical and horizontal directions.

Next, painting methods using the liquid jet head of the present embodiment are described. First, a painting method according to a first embodiment is described.

Painting Method of First Embodiment

In the painting method according to the first embodiment, when dots (which may be hereafter referred to as "right-to-left dots") are formed in a row at regular intervals (pitch) from right to left such that the right-to-left dots overlap a row of dots (which may be hereafter referred to as "left-to-right dots") formed from left to right, a satellite dot protruding from an edge of the last left-to-right dot is hidden by shifting the center of each right-to-left dot from the center of the corresponding left-to-right dot to the right by a distance greater than or equal to a distance d between the edge of the last left-to-right dot and the satellite dot. This is explained in more detail with reference to FIG. 3.

Figure 3:
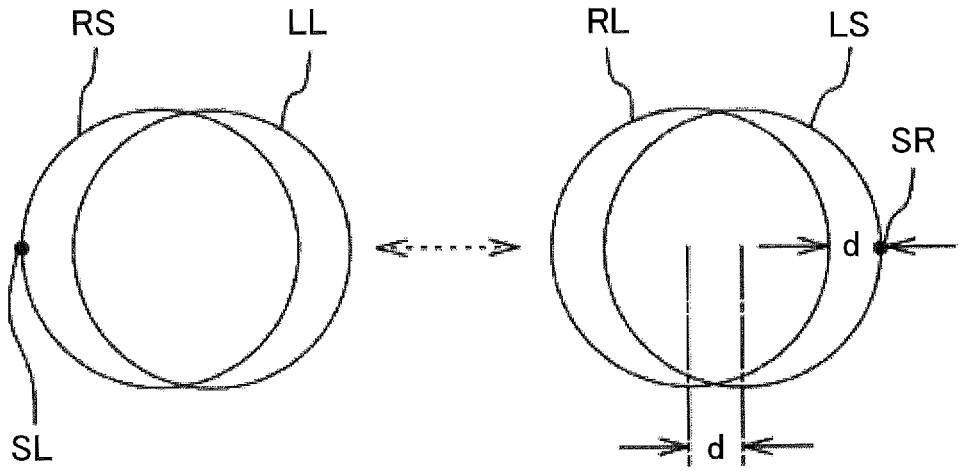
FIG. 3 is a drawing illustrating a painting method according to a first embodiment.

FIG. 3 is a drawing illustrating the painting method according to the first embodiment. In FIG. 3, RS indicates the first dot in a row of left-to-right dots, RL indicates the last dot in the row of left-to-right dots, and SR indicates a satellite dot of the last dot RL. Also, LS indicates the first dot in a row of right-to-left dots, LL indicates the last dot in the row of right-to-left dots, and SL indicates a satellite dot of the last dot LL.

As illustrated in FIG. 3, when "d" indicates the distance between the right edge of the last left-to-right dot RL and the satellite dot SR, the satellite dot SR can be hidden by shifting the center of each right-to-left dot from the center of the corresponding left-to-right dot to the right by a distance greater than or equal to the distance d. That is, when the center of the first right-to-left dot LS is shifted from the center of the last left-to-right dot RL to the right by a distance greater than or equal to the distance d, the satellite dot SR is included in the first right-to-left dot LS and becomes invisible. Also, because the center of the last right-to-left dot LL is shifted from the center of the first left-to-right dot RS to the right by a distance greater than or equal to the distance d, the satellite dot SL falls on the first left-to-right dot RS and becomes invisible.

A control program for controlling the PLC 71, the nozzle control circuit 73, and the motor controller 76 to shift the dots by the distance d may be installed beforehand in the computer (PC) 70. According to the control program, the computer 70 causes the motor controller 76 to control the X-axis moving mechanism 3 and the Y-axis moving mechanisms 4 of the XY table to move the nozzle head 2 at an optimum speed, causes the nozzle control circuit 73 to control the timing of discharging paint and the amount of paint to be discharged, and thereby performs the above control process.

Also, according to the present embodiment, an image of a recording head moved at a predetermined speed may be captured with, for example, a camera (not shown), and the controller may determine the distance d based on the captured image and store the determined distance d in a storage (not shown). Also, when the recording head is moved at a speed different from the predetermined speed, the controller may change the distance d based on the predetermined speed and the speed of the recording head.

Effect of First Embodiment

In the painting method using the liquid jet head according to the first embodiment, a first row of dots is formed by causing the nozzle head 2 to discharge paint at regular intervals while moving the nozzle head 2 in a first direction, and a second row of dots is formed to overlap the first row of dots by causing the nozzle head 2 to discharge the paint at the same regular intervals while moving the nozzle head 2 in a second direction opposite the first direction such that the center of the first dot in the second row of dots is shifted from the center of the last dot in the first row of dots toward a satellite dot by a distance greater than or equal to the distance d. This method makes it possible to form a painting area with a clear edge with no noise dot while using the nozzle head 2 with a normal shape, i.e., without changing the nozzle head 2 to have a special shape.

In the present embodiment, paint is discharged while moving the head held on the XY table in the XY directions. However, the present invention is not limited to this embodiment. For example, the head may be fixed and an object to be painted may be moved in the XY directions, or both of the head and the object may be moved. Also, liquid may be discharged while moving the head in the YZ directions or the XZ directions.

Painting Method of Second Embodiment

Figure 4:
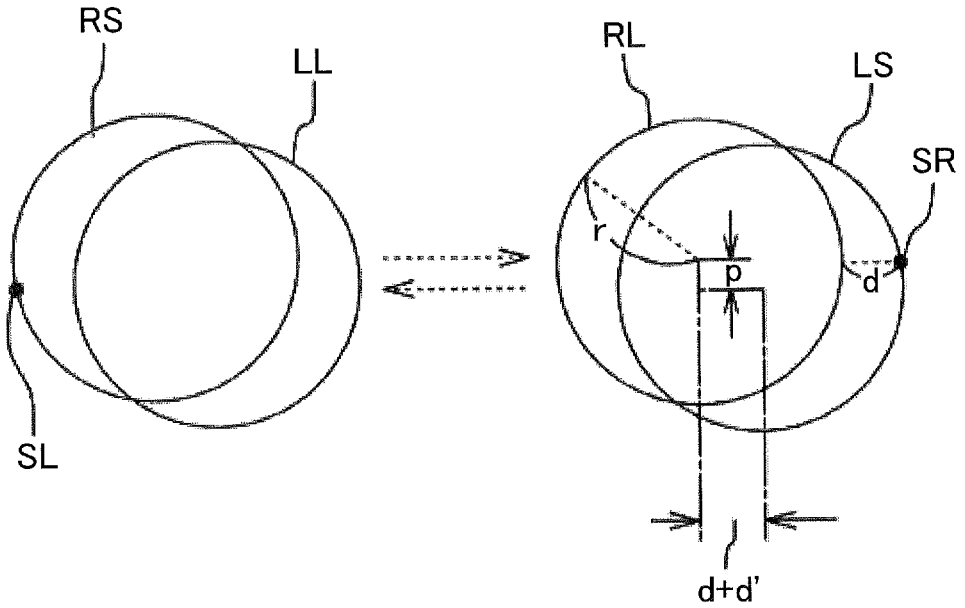
FIG. 4 is a drawing illustrating a painting method according to a second embodiment.

Next, a painting method according to a second embodiment is described. FIG. 4 is a drawing illustrating the painting method according to the second embodiment. Similarly to FIG. 3, RS indicates the first dot in a row of left-to-right dots, RL indicates the last dot in the row of left-to-right dots, SR indicates a satellite dot of the last dot RL, LS indicates the first dot in a row of right-to-left dots, LL indicates the last dot in the row of right-to-left dots, and SL indicates a satellite dot of the last dot LL. In FIG. 4, however, each of the first dot LS through the last dot LL in the row of right-to-left dots is lowered in the Y direction by a predetermined pitch p from the corresponding one of the first dot RS through the last dot RL in the row of left-to-right dots. In the painting method of the second embodiment, a row of right-to-left dots is formed at the same regular intervals as a row of left-to-right dots such that the row of right-to-left dots is positioned lower than the row of left-to-right dots by a predetermined pitch. When d indicates the distance between an edge of the last left-to-right dot and its satellite dot, r indicates the radius of the dots, and p indicates the pitch, as illustrated in FIG. 4, the satellite dot is hidden by shifting the center of each of the right-to-left dots from the center of the corresponding one of the left-to-right dots by a distance greater than or equal to a value calculated by formula (1) below.

$$d+(r-\sqrt{r^2-p^2}) \tag{1}$$

This method is described in more detail with reference to FIG. 5.

Figure 5:
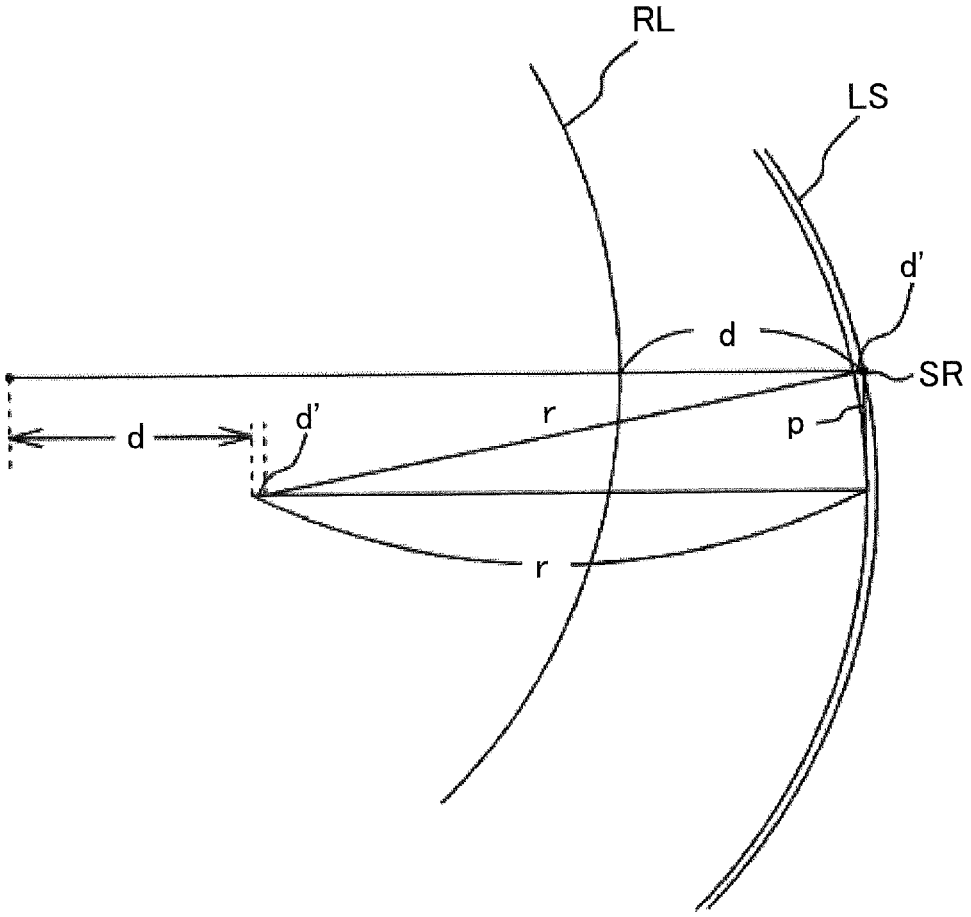
FIG. 5 is a drawing illustrating a dot shift amount in the painting method according to the second embodiment.
Figure 6:
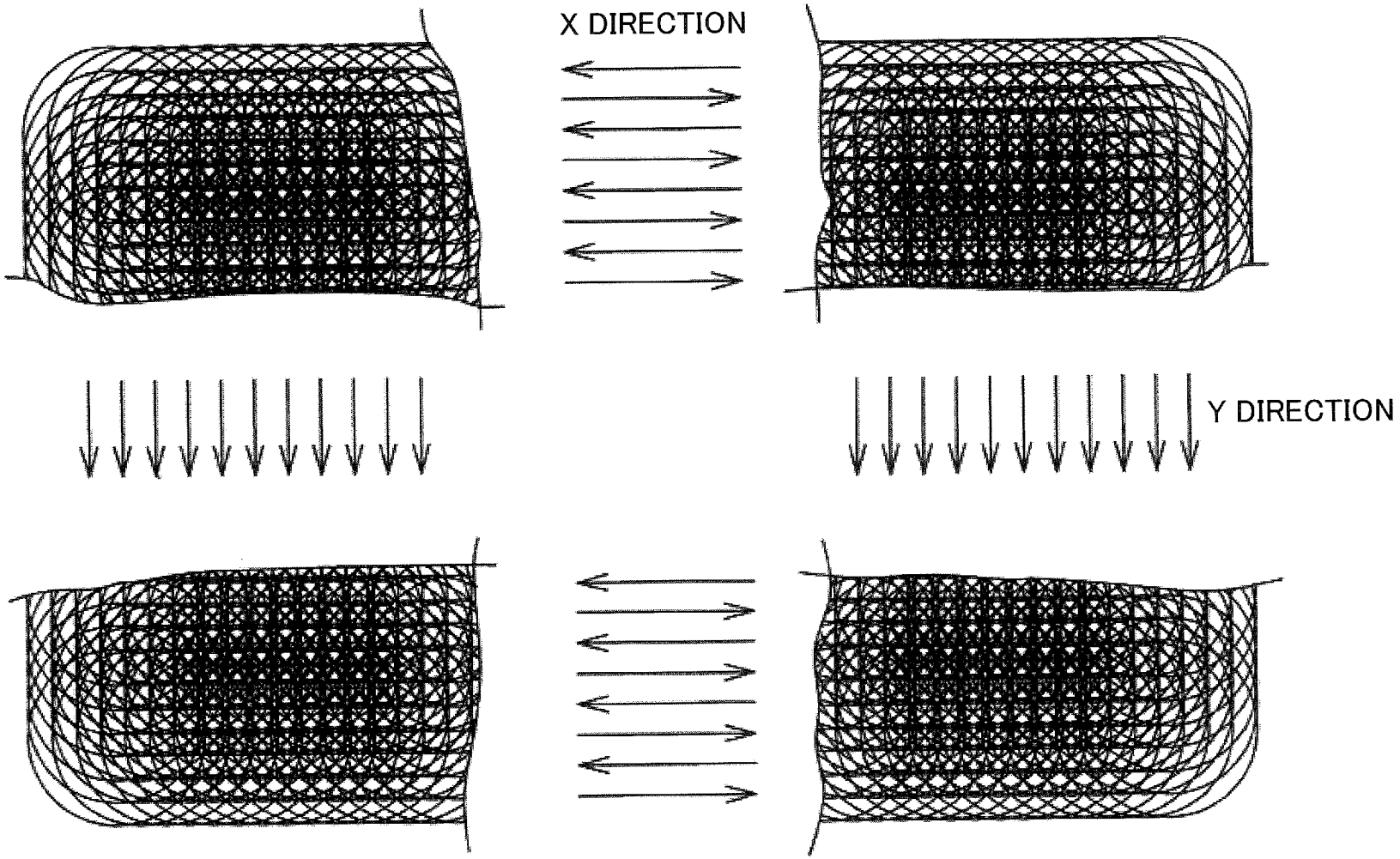
FIG. 6 is an enlarged view of paint dots.
Figure 7A:
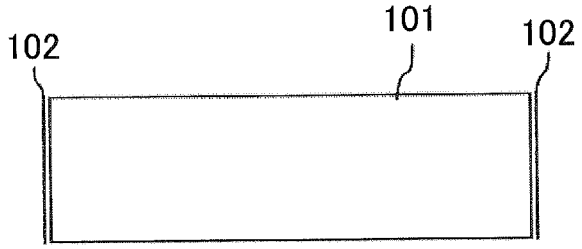
FIG. 7A is a drawing illustrating dot groups protruding from a painting area.
Figure 7B:
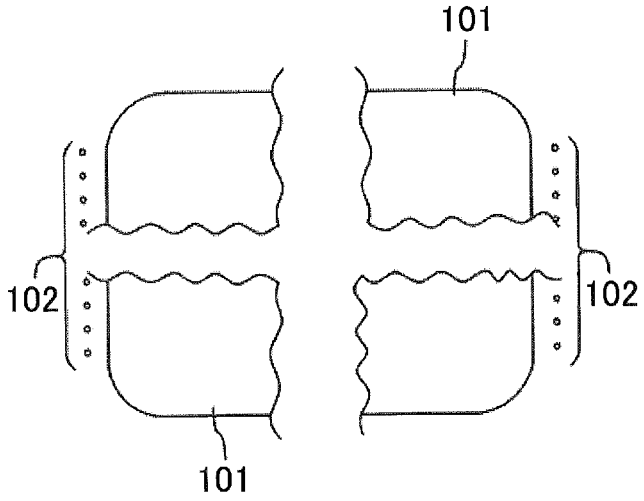
FIG. 7B is an enlarged view of the protruding dot groups.
Figure 8A:
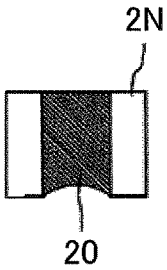
FIGS. 8A through 8E are drawings illustrating a process where dots are formed.
Figure 8B:
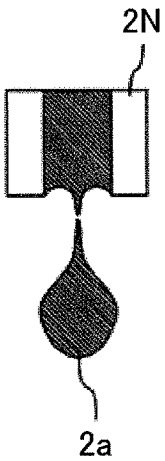
Figure 8C:
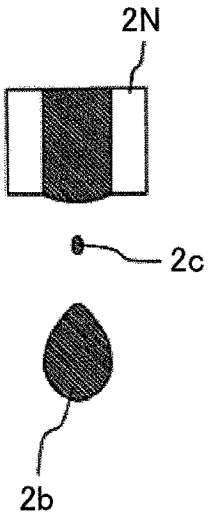
Figure 8D:
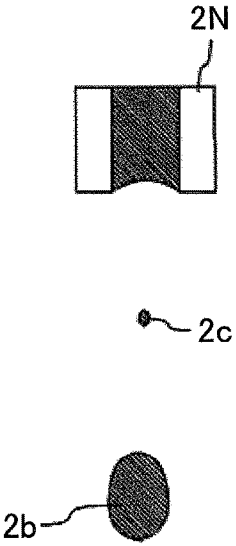
Figure 8E:
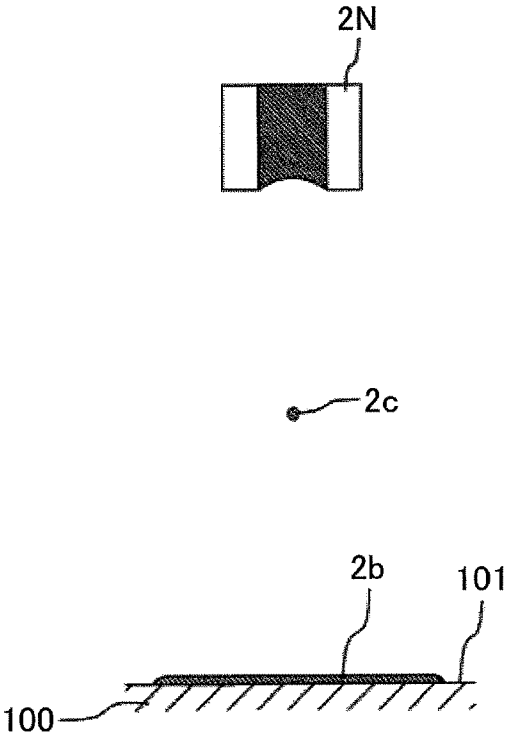
Figure 9:
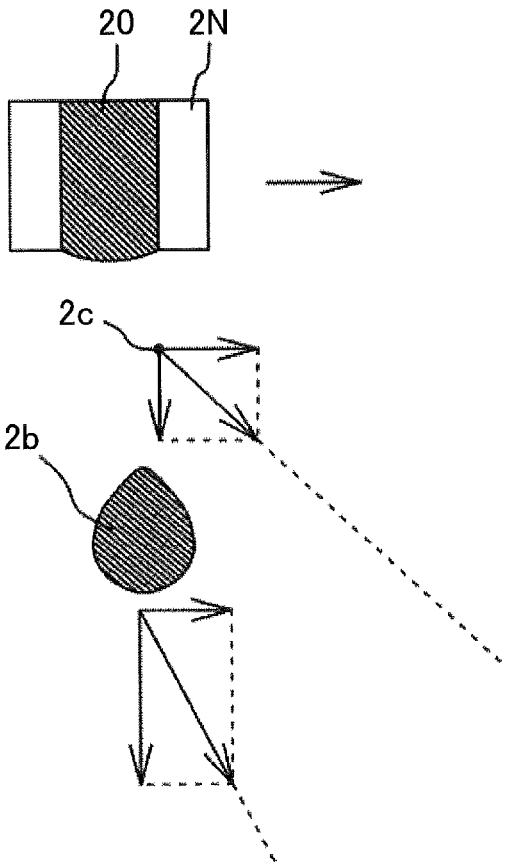
FIG. 9 is a drawing illustrating falling directions of a parent dot and a satellite dot.

FIG. 5 is a drawing illustrating a dot shift amount in the painting method according to the second embodiment. In FIG. 5, r indicates the radius of the dots, p indicates a pitch, and d indicates a distance between the right edge of the last dot RL and the satellite dot SR.

As illustrated in FIG. 5, when the center of the first right-to-left dot LS is shifted from the center of the last left-to-right dot RL by a distance greater than or equal to (d+d'), the satellite dot SR overlaps the first right-to-left dot LS and becomes invisible. Here, d' is calculated by formula (2) below.

$$d'=r-\sqrt{r^2-p^2} \tag{2}$$

For example, when r=1.0 mm and p=0.2 mm, d' becomes 0.02 mm, and the center of the right-to-left dot is shifted by (d+d'), i.e., 0.4+0.02 mm=0.42 mm.

Formulas (3) below indicate a process of calculating d'.

$$\begin{aligned} r^2 &= (r-d')^2 + p^2 \\ r^2 &= r^2 - 2rd' + d'^2 + p^2 \\ 0 &= p^2 - 2rd' + d'^2 \\ d'^2 - 2rd' + p^2 &= 0 \\ d' &= \frac{2r \pm \sqrt{4r^2 - 4p^2}}{2} \\ d' &= r - \sqrt{r^2 - p^2} \end{aligned} \tag{3}$$

Similarly to the first embodiment, a control program for controlling the PLC 71, the nozzle control circuit 73, and the motor controller 76 to shift the dots by the distance d may be installed beforehand in the computer (PC) 70. According to the control program, the computer 70 causes the motor controller 76 to control the X-axis moving mechanism 3 and the Y-axis moving mechanisms 4 of the XY table to move the nozzle head 2 at an optimum speed and an optimum pitch, causes the nozzle control circuit 73 to control the timing of discharging paint and the amount of paint to be discharged, and thereby performs the above control process.

Effect of Second Embodiment

In the painting method using the liquid jet head according to the second embodiment, a first row of dots is formed by causing the nozzle head 2 to discharge paint at regular intervals while moving the nozzle head 2 in a first direction, and a second row of dots is formed at a position shifted from the first row of dots by the pitch P in a direction orthogonal to the first direction by causing the nozzle head 2 to discharge the paint at the same regular intervals as the first row of dots while moving the nozzle head 2 in a second direction opposite the first direction. In this method, when r indicates the radius of the main dot discharged from the nozzle head 2 to the object surface, the center of the first dot in the second row of dots is shifted from the center of the last dot in the first row of dots toward a satellite dot by a distance greater than or equal to a value calculated by formula (1) below. This method makes it possible to form a painting area with a clear edge with no noise dot while using the nozzle head 2 with a normal shape, i.e., without changing the nozzle head 2 to have a special shape.

$$d+(r-\sqrt{r^2-p^2}) \quad (1)$$

A liquid jet device and a painting method according to embodiments of the present invention are described above. However, the present invention is not limited to the specifically disclosed embodiments, and variations and modifications may be made without departing from the scope of the present invention.

What is claimed is:

1. A liquid jet device, comprising:

a head that discharges liquid to an object;

a moving mechanism that moves at least one of the object and the head; and a controller that causes the head to discharge the liquid while moving the at least one of the object and the head in a first direction to form a first row of dots arranged in the first direction, and causes the head to discharge the liquid while moving the at least one of the object and the head in a second direction opposite the first direction to form a second row of dots, which are arranged in the second direction and overlapping the first row of dots, at a substantially same position as the first row of dots in a direction orthogonal to the first direction, wherein the controller causes a center of a first dot in the second row of dots to be horizontally shifted in the first direction from a center of a last dot in the first row of dots by a distance greater than or equal to a distance d between the last dot and a satellite dot of the last dot.

2. The liquid jet device as claimed in claim 1, wherein the controller causes the head to discharge the liquid at predetermined intervals while moving the at least one of the object and the head in the first direction, and causes the head to discharge the liquid at the predetermined intervals while moving the at least one of the object and the head in the second direction.

3. The liquid jet device as claimed in claim 1, wherein the controller causes the center of the first dot in the second row of dots to be shifted from the center of the last dot in the first row of dots toward the satellite dot of the last dot by the distance greater than or equal to the distance d.

4. A liquid jet device, comprising:

a head that discharges liquid to an object;

a moving mechanism that moves at least one of the object and the head; and a controller that causes the head to discharge the liquid while moving the at least one of the object and the head in a first direction to form a first row of dots arranged in the first direction, and causes the head to discharge the liquid while moving the at least one of the object and the head in a second direction opposite the first direction to form a second row of dots at a position shifted from the first row of dots by a pitch p in a direction orthogonal to the first direction, the second row of dots being arranged in the second direction and overlapping the first row of dots, wherein when r indicates a radius of each dot in the first row of dots and the second row of dots and d indicates a distance between a last dot in the first row of dots and a satellite dot of the last dot, the controller causes a center of a first dot in the second row of dots to be shifted in the first direction from a center of the last dot in the first row of dots by a distance greater than or equal to a value calculated by a following formula (1):

$$d+(r-\sqrt{r^2-p^2}) \quad (1).$$

5. The liquid jet device as claimed in claim 4, wherein the controller causes the head to discharge the liquid at predetermined intervals while moving the at least one of the object and the head in the first direction, and causes the head to discharge the liquid at the predetermined intervals while moving the at least one of the object and the head in the second direction.

6. The liquid jet device as claimed in claim 4, wherein the controller causes the center of the first dot in the second row of dots to be shifted from the center of the last dot in the first row of dots toward the satellite dot of the last dot by the distance greater than or equal to the distance d.

* * * * *